US006438487B1

(12) United States Patent
Mingo et al.

(10) Patent No.: US 6,438,487 B1
(45) Date of Patent: Aug. 20, 2002

(54) METHOD AND SYSTEM FOR DETERMINING THE OPERATIONAL STATE OF A VEHICLE STARTER MOTOR

(75) Inventors: Paul Charles Mingo, Farmington Hills; Thomas Francis Mausolf, Livonia; William Russell Goodwin, Farmington Hills, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 51 days.

(21) Appl. No.: 09/789,690

(22) Filed: Feb. 21, 2001

(51) Int. Cl.[7] ..... F02N 11/08

(52) U.S. Cl. ..... 701/113; 73/118.1; 123/179.3; 290/38 R

(58) Field of Search ..... 701/113, 114; 123/179.3; 290/38 R, 38 C; 73/118.1

(56) References Cited

U.S. PATENT DOCUMENTS

| | | | | |
|---|---|---|---|---|
| 4,056,765 A | | 11/1977 | Scheidler et al. | |
| 4,198,945 A | | 4/1980 | Eyermann et al. | |
| 4,955,336 A | | 9/1990 | Glowczewski et al. | |
| 5,905,315 A | * | 5/1999 | Lefebvre et al. | 123/179.3 |
| 5,970,936 A | | 10/1999 | Cabrera et al. | |
| 5,992,365 A | | 11/1999 | Vilou | |

* cited by examiner

*Primary Examiner*—Andrew M. Dolinar
(74) *Attorney, Agent, or Firm*—Carlos L. Hanze

(57) ABSTRACT

A method for determining an operational state of a vehicle starter motor coupled to vehicle battery includes the steps of detecting a vehicle battery voltage, deriving an average vehicle battery voltage, and inferring the operational state of the starter motor based at least in part on a difference between the detected vehicle battery voltage and the average vehicle battery voltage.

13 Claims, 9 Drawing Sheets

METHOD AND SYSTEM FOR DETERMINING THE OPERATIONAL STATE OF A VEHICLE STARTER MOTOR

BACKGROUND OF THE INVENTION

1. Field of the Invention

The present invention relates generally to a system and method for operating a motor vehicle. More particularly, the invention relates to a method for inferring the operational status of a vehicle starter motor.

2. Background Art

Early disengagement of a vehicle starter motor can result in no-start, reverse run and air/fuel mixture conditions that can damage or diminish the longevity of engine components. These problems often arise, for example, when an operator attempts to crank a vehicle's starter but prematurely releases the vehicle ignition switch. If the switch is not held in the START position for a long enough period of time, a spring mechanism inside the switch will push the key back to the switch's RUN position, thus disconnecting the battery from the starter solenoid and disengaging the starter motor. Repeated misstarts may degrade the starter motor and reduce its longevity, increase vehicle fuel emissions during vehicle cold start conditions, and also affect a customer's satisfaction with the vehicle.

As such, in order to prevent reverse run and other conditions that may result in inappropriate ignition of an air/fuel mixture, it is desirable when starting the vehicle to know whether the starter motor is engaged or disengaged. By knowing whether the starter is disengaged, for example, a vehicle's control system can be operated to cease fuel supply and/or deactivate spark actuation so as to avoid a reverse rotation "backfire" condition of the engine. Knowledge of the starter operational state can also be used in scheduling power-up of other vehicle electrical subsystems or components, for example climate control, entertainment and navigational subsystems. Conventional systems for monitoring starter operation however utilize rotation detectors that typically do not differentiate between forward and reverse rotary motion of the engine. Other alternatives, such as key and rotary position sensors, are costly and more difficult to implement into a typical vehicle control strategy.

Accordingly, the inventors herein have recognized an opportunity for inferring the operational state of a vehicle starter motor by monitoring changes in battery voltage during the vehicle starting process.

SUMMARY OF THE INVENTION

The aforedescribed limitations of conventional automobile starting systems are substantially overcome by the present invention, in which a method is provided for determining an operational state of a vehicle starter motor coupled to vehicle battery. The method includes the steps of detecting a vehicle battery voltage, deriving an average ("filtered" or "steady-state") vehicle battery voltage and inferring the operational state of the starter motor based at least in part on a difference between the detected vehicle battery voltage and the filtered vehicle battery voltage.

An advantage of the present invention is that the operational state of a vehicle starter motor can be accurately determined without using an engine rotation detector or starter voltage/current sensor hard-wired to a vehicle's engine or powertrain controller. In accordance with the present invention, the engagement and disengagement of the starter may be inferred from changes in the battery voltage without wiring and control module costs associated with hard-wired sensors. The disclosed method and system can be used advantageously to minimize occurrences of vehicle no-starts, avoid reverse rotation of the engine and prevent undesired ignition of an air/fuel mixture.

Further advantages, objects and features of the present invention will become apparent from the following detailed description of the invention taken in conjunction with the accompanying figures showing illustrative embodiments of the invention.

BRIEF DESCRIPTION OF THE DRAWINGS

For a complete understanding of the present invention and the advantages thereof, reference is now made to the following description taken in conjunction with the accompanying drawings in which like reference numerals indicate like features and wherein.

DETAILED DESCRIPTION OF THE PREFERRED EMBODIMENTS

Figure 1:
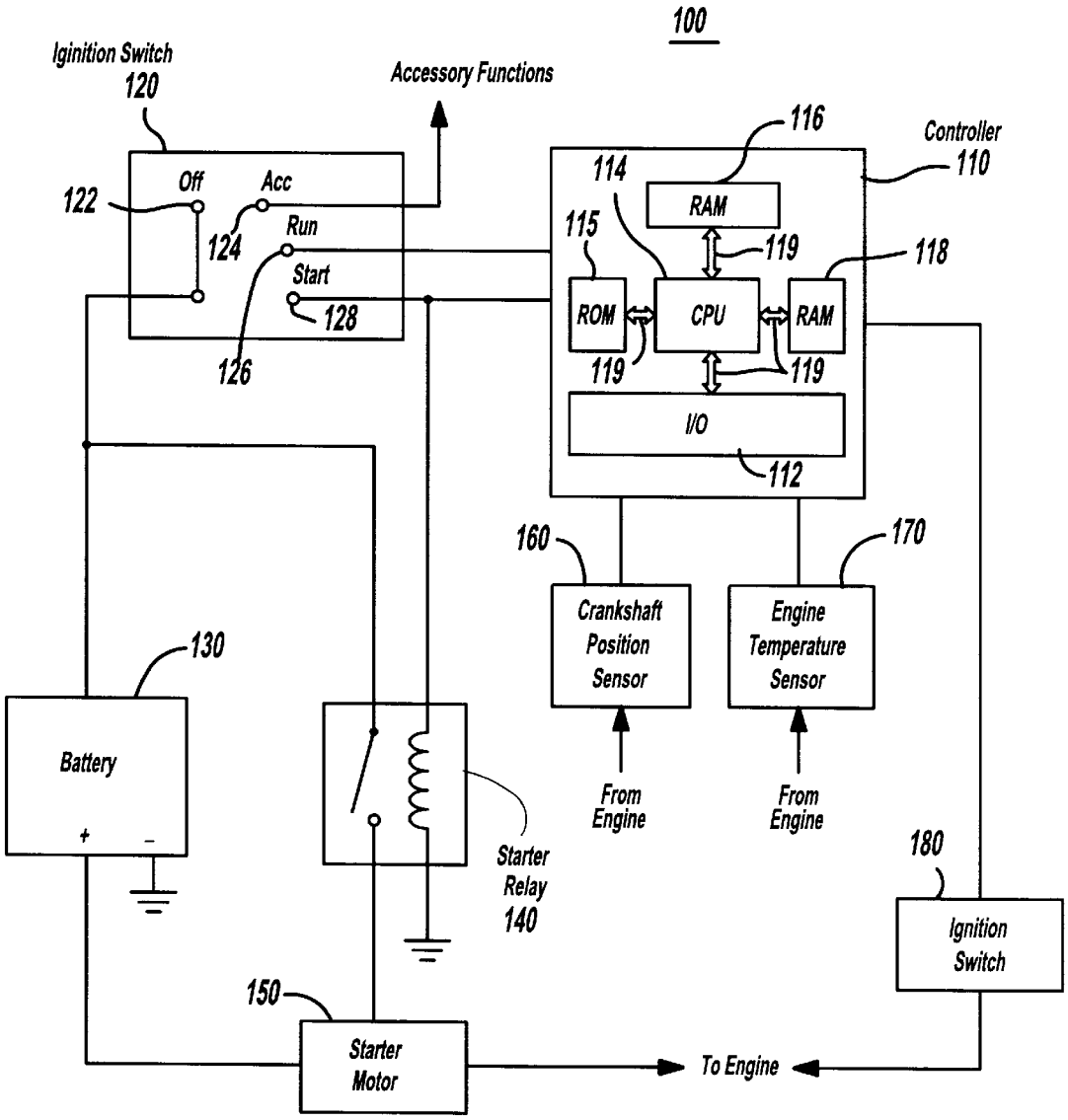
FIG. 1 is a block diagram of a system for determining the operational status of a vehicle starter motor in accordance with a preferred embodiment of the present invention.

FIG. 1 shows a block diagram of a conventional vehicle starting system utilizing the method of the present invention for determining the operational status of a vehicle starter motor. The system is an exemplary vehicle starting system, and is not intended in any way to limit the scope of the present invention.

As shown in FIG. 1, the system includes a starter motor 150 coupled to a battery 130 via a starter relay 140. When engaged via an ignition key switch, shown for example as a four-position switch key switch 120, the starter relay 140 is activated and electrical power is enabled from the battery 130 to the starter motor 150 for vehicle start-up. Concurrently, the ignition switch 120 enables power to other vehicle systems, including for example controller 110. The ignition switch 120 includes at least one OFF or lock position 122, an ACC position 124, a RUN position 126, and a START position 128.

The controller 110 is provided for performing the methods of the present invention described below with reference to FIGS. 2, 3, 6 and 7. The controller 110, which can be any suitable powertrain controller or suitable powertrain controller or microprocessor-based module, monitors sensor inputs and determines any necessary control actions when activated. Nominally, the controller includes a central processing unit (CPU) 114, one or more data buses 119 of any suitable configuration, corresponding input/output ports 112, random-access memory (RAM) 118, keep-alive memory (KAM) 116 and read-only memory (ROM) or equivalent electronic storage medium 115 containing processor-executable instructions and database values for performing engine operations in accordance with the methods of FIGS. 2, 3, 6 and 7.

In addition, the controller 120 receives various signals from conventional vehicle sensors, the sensors including but not being limited to an engine speed sensor and an engine temperature sensor. Preferably, the engine speed sensor is a crankshaft position sensor (CPS) 160 disposed with respect to a pulse ring formed or mounted on the crankshaft. The engine temperature sensor 170 is preferably an engine coolant temperature sensor (ECT) mounted within the engine block as known in the art. The CPS generates an electrical signal based on the detection of so-called teeth disposed on the pulse ring. The electrical signal is in turn provided to an ignition system 180 via the controller 110.

Figure 2:
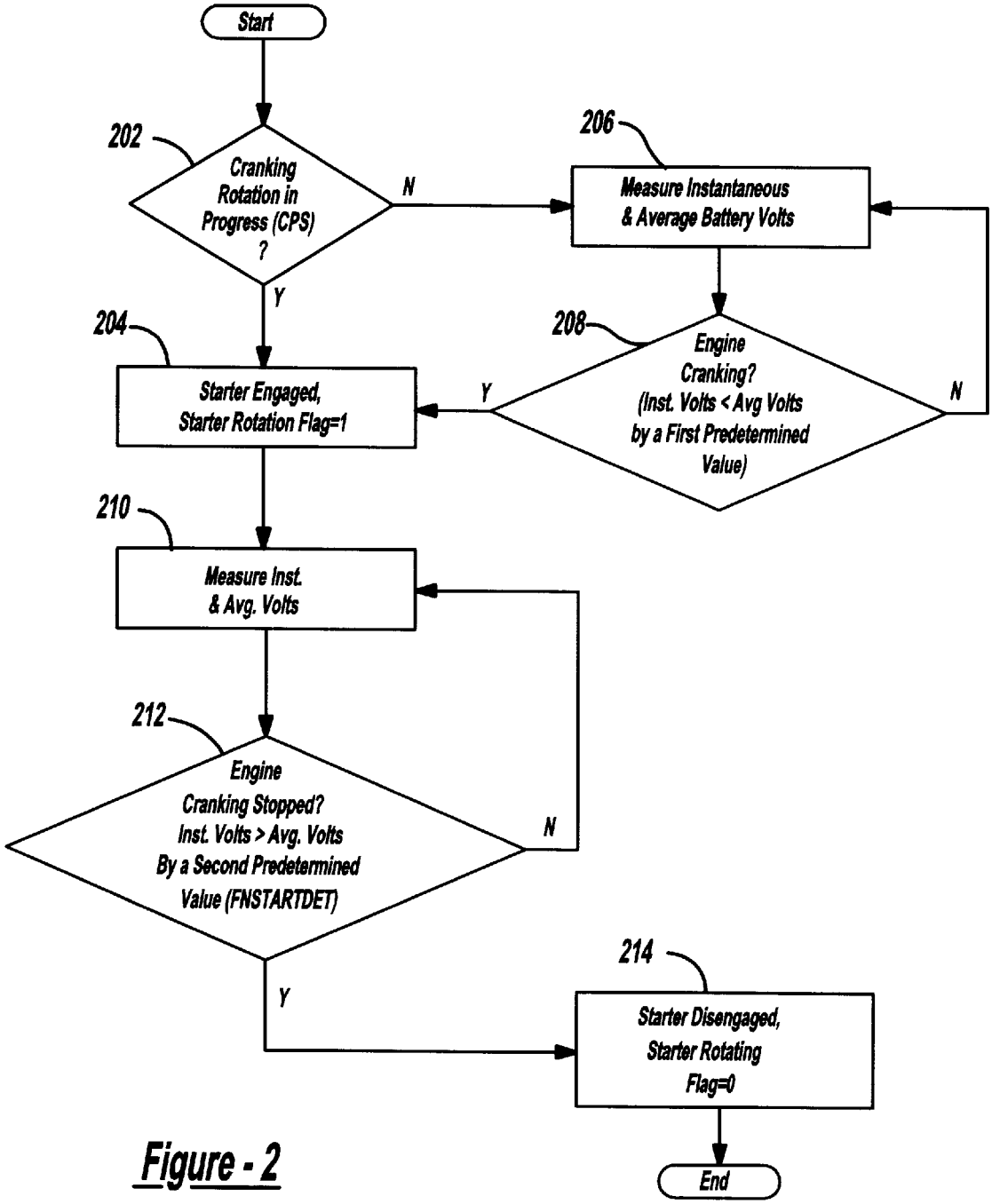
FIG. 2 is a flow diagram of a preferred method for determining the operational status of a vehicle starter motor in accordance with the present invention.

FIG. 2 shows a flow diagram of a preferred method for determining the operational status of a vehicle starter motor. In accordance with the logic shown in FIG. 2, a controller first detects whether engine cranking rotation is in progress, step 202. This is done for example by determining whether a CPS is generating pulses indicative of engine rotation. If a sufficient number if pulses are generated, or alternatively if pulses are continuously generated for predetermined period of time, then a flag in the controller logic is set to indicate the starter is engaged, step 204. If no rotation is detected, then the instantaneous voltage of the vehicle battery is measured and an average battery voltage determined, step 206. The average battery voltage can be determined using any suitable means. After a predetermined period of time, the instantaneous battery voltage is then compared to the average battery voltage, step 208. If the average battery voltage is greater than the instantaneous voltage by a first voltage threshold value, then the starter operational state is inferred to be engaged, step 204.

If the starter state is "engaged" in accordance with step 204, then the instantaneous battery voltage is again measured and the average battery voltage determined, step 210. After a predetermined period of time, the instantaneous battery voltage is then again compared to the average battery voltage, step 212. This time however a logic checks to determine whether the instantaneous battery voltage exceeds the average battery voltage. If the instantaneous exceeds the average voltage by a second voltage threshold value, then the logic sets the appropriate flag to indicate that the starter is disabled, step 214. Alternatively, the first and second threshold values can be the same.

Figure 3A:
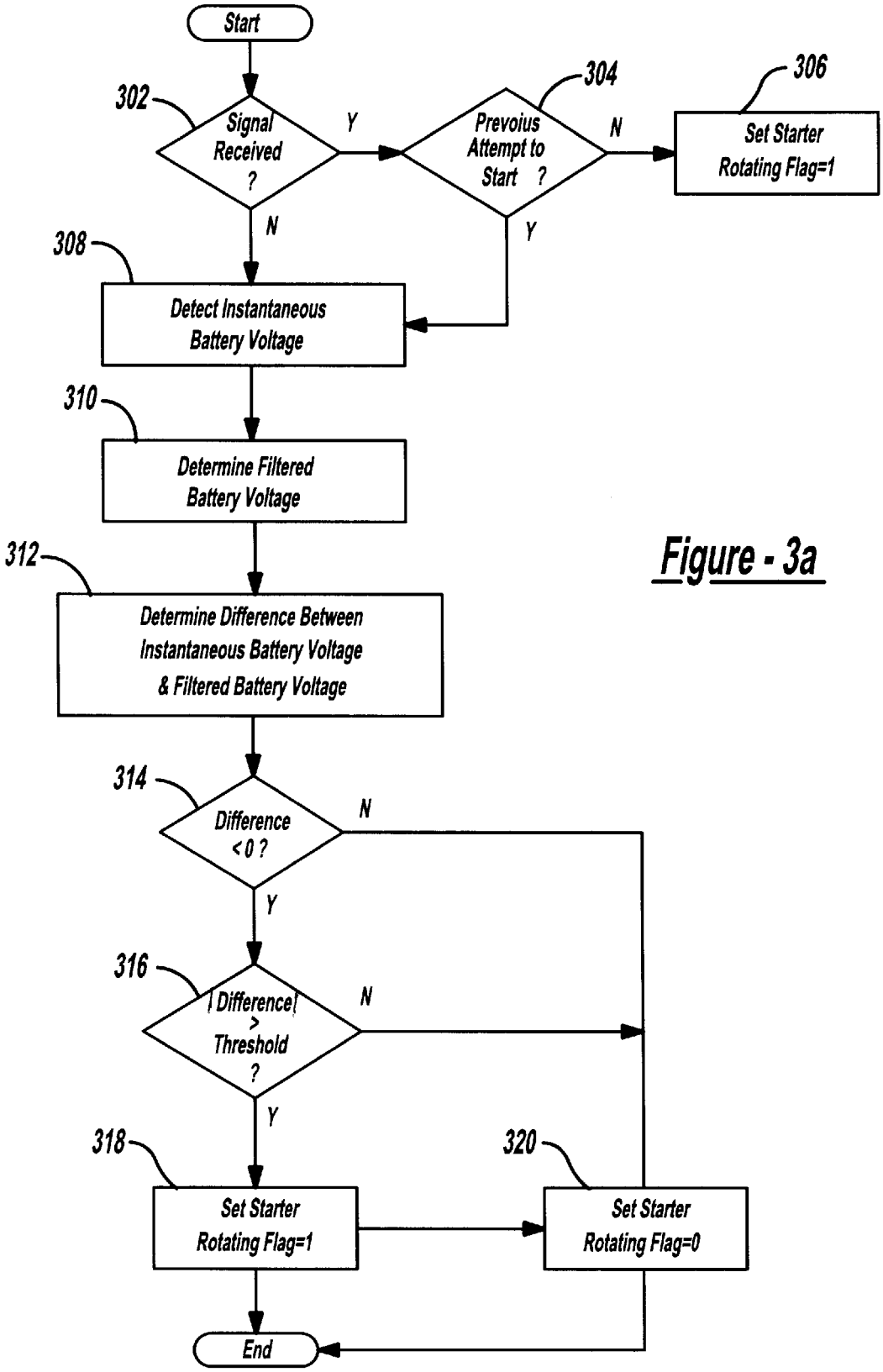
FIG. 3A is a flow diagram of another preferred method for determining the operational status of a vehicle starter motor in accordance with the present invention.

FIG. 3A shows a flow diagram of another preferred method for determining the operational status of a vehicle starter motor in accordance with the present invention. As shown in FIG. 3A, a check of controller memory is performed in accordance with step 301 to determine whether the starter motor is disabled, i.e., "Starter Rotating" flag (STARTER_ROTATING) set to "0". A check is then performed to determine whether the vehicle's engine is rotating. This can be done for example by determining whether a valid signal has been received from a CPS disposed with respect the engine's crankshaft, step 302. If a valid signal is received, then a query is done of controller memory to determine whether an attempt has been made recently within a prescribed period of time to start the vehicle's engine, step 304. If an attempt has not been made to start the vehicle within the prescribed period of time, then STARTER_ROTATING is set to "1" and the starter motor is inferred by the controller to be engaged, step 306.

If by contrast a recent attempt has been made to start the engine, then the controller monitors the vehicle's battery voltage level ($VBAT_n$) via an appropriate sensor, step 308. The battery voltage is then filtered, for example using a first order filter, to derive a filtered battery voltage ($VBAT_STARTER_n$), step 310. $VBAT_STARTER_n$ can be derived for example using the following expression:

$$VBAT_STARTER_n=(c*VBAT_n)+(1-c)*VBAT_STARTER_{n-1};$$

where $VBAT_n$, is the measured, instantaneous battery voltage during the present iteration n, $VBAT_STARTER_{n-1}$ is the filtered battery voltage from the previous iteration, and c is a calibratable filter constant based on one or more vehicle (including engine) operating parameters. The filter constant c is determined empirically to differentiate background noise from true disengagement of the starter under various potential operating parameters of the vehicle. In accordance with a preferred method of the present invention, the filter constant c is determined as a function of engine coolant temperature and battery charge state. Nominally, the computations described above are made every 16 milliseconds.

Next, in accordance with step 312, a difference (VBAT_DIFF) is computed between $VBAT_n$ and $VBAT_STARTER_{n-1}$. If VBAT_DIFF is less than zero, step 314, then the absolute value of VBAT_DIFF is compared to a starter engaged/disengaged threshold value (FNSTARTDET), step 316. If the absolute value of VBAT_DIFF exceeds FNSTARTDET, then STARTER_ROTATING is set to "1" and the starter motor is inferred to be engaged. Nominally, the condition of step 316 must exist for at least two iterations, i.e., at least two control loops of 16 milliseconds each, for the starter engaged state to be inferred. Referring again to steps 314 and 316, if the VBAT_DIFF is greater than zero in accordance with step 214 or the absolute value of VBAT_DIFF is less than FNSTARTDET in accordance with step 316, then STARTER_ROTATING is set to "0" and the starter motor is inferred to be disengaged.

Figure 3B:
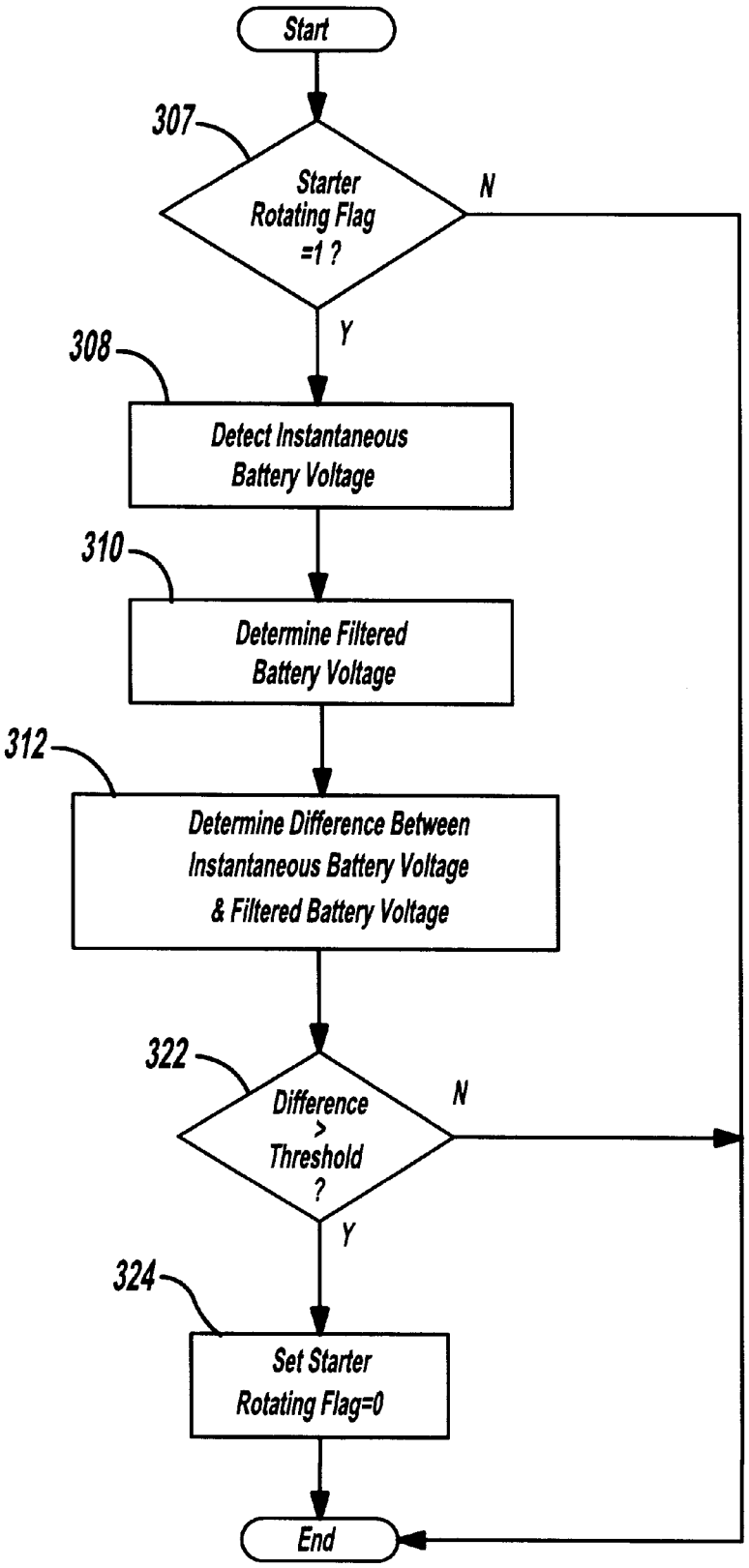
FIG. 3B is a flow diagram of yet another preferred method for determining the operational status of a vehicle starter motor in accordance with the present invention.

After the starter motor is engaged, the controller of FIG. 1 uses logic for inferring disablement of the starter motor. This logic performs the method shown in FIG. 3B, which includes steps similar to the method of FIG. 3A. As shown in FIG. 3B, after a check is done to verify that the starter is engaged, e.g., STARTER_ROTATING=1 as shown by step 307, then steps 308, 310 and 312 are performed as described above to determine $VBAT_n$, $VBAT_STARTER_n$, and VBAT_DIFF. If VBAT_DIFF exceeds the threshold FNSTARTDET, step 322, then STARTER_ROTATING is set to "0" and the starter motor is inferred as being disengaged, step 324. Nominally, the condition of step 322 must exist for at least two iterations, i.e., at least two control loops of 16 milliseconds each, for the starter disengaged state to be inferred. Otherwise, the starter is inferred as remaining in an engaged state.

Figure 4:
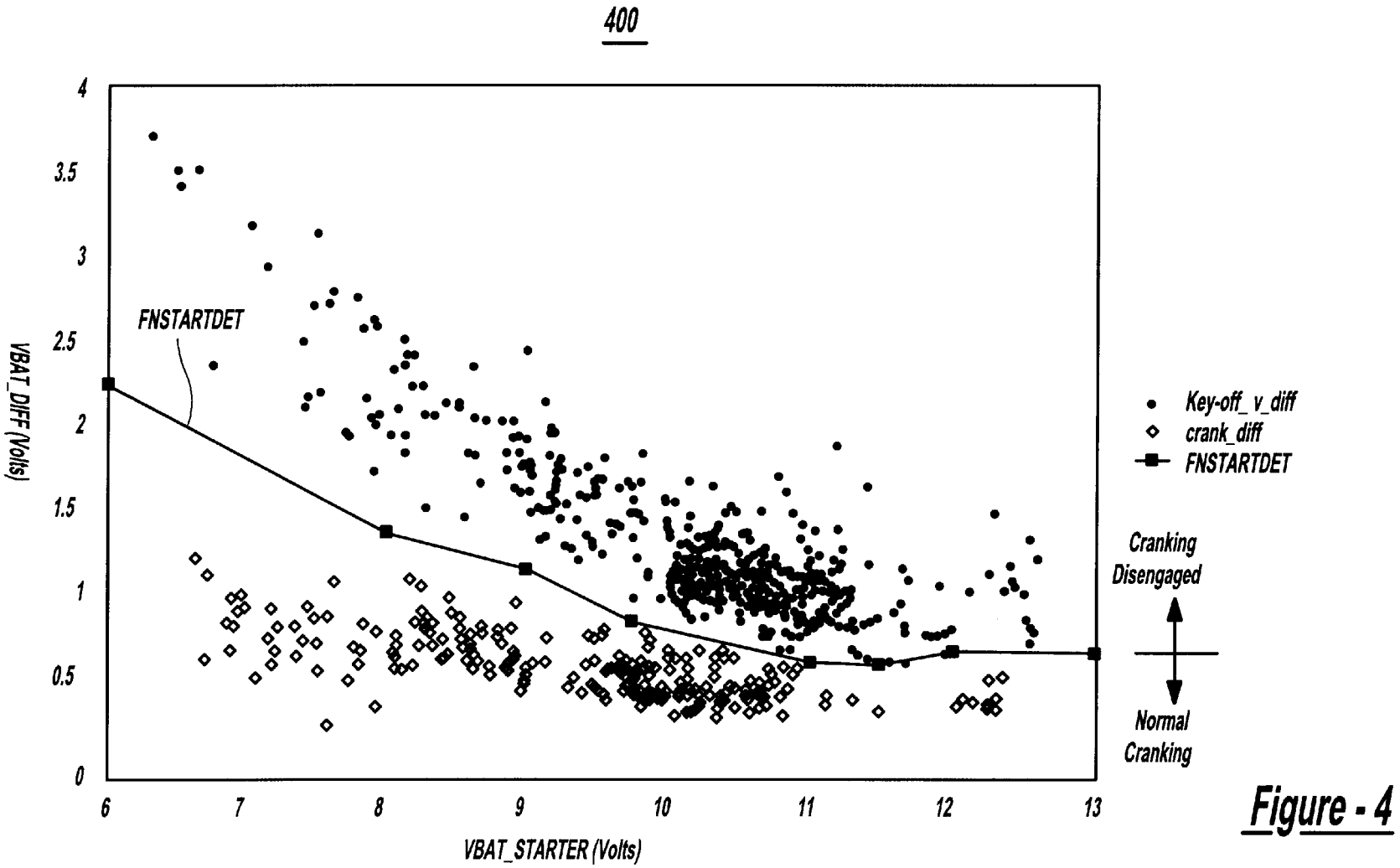
FIG. 4 is an exemplary plot showing of a voltage threshold for determining the engagement and disengagement of a vehicle starter motor.

FIG. 4 shows an exemplary plot 400 of FNSTARTDET for determining the engagement and disengagement of a vehicle starter motor. The plot shows VBAT_DIFF values for given values of $VBAT_STARTER_n$, derived in either an inactive "key-off", "starter motor disengaged" vehicle mode (dotted data points) or a vehicle "crank", "starter motor engaged" vehicle mode (diamond data points). Based on repeated measurements of the instantaneous battery voltage and computation of the filtered battery voltage and VBAT_DIFF, the data points shown in FIG. 3 shown a demarcation between starter engaged and disengaged modes. Accordingly, as shown in FIG. 4, the FNSTARTDET threshold is calibratable as a function of $VBAT_STARTER_n$ to most accurately indicate the starter motor as being engaged or disengaged. Preferably, if the starter motor has been engaged, and if a subsequent value of VBAT_DIFF exceeds FNSTARTDET, then the starter is inferred to be disengaged at the time VBAT_DIFF exceeds FNSTARTDET. If as described above the starter motor is disengaged and the value of VBAT_DIFF is negative and the absolute value thereof is less than or equal to FNSTARTDET, then the starter is inferred to be engaged.

Figure 5:
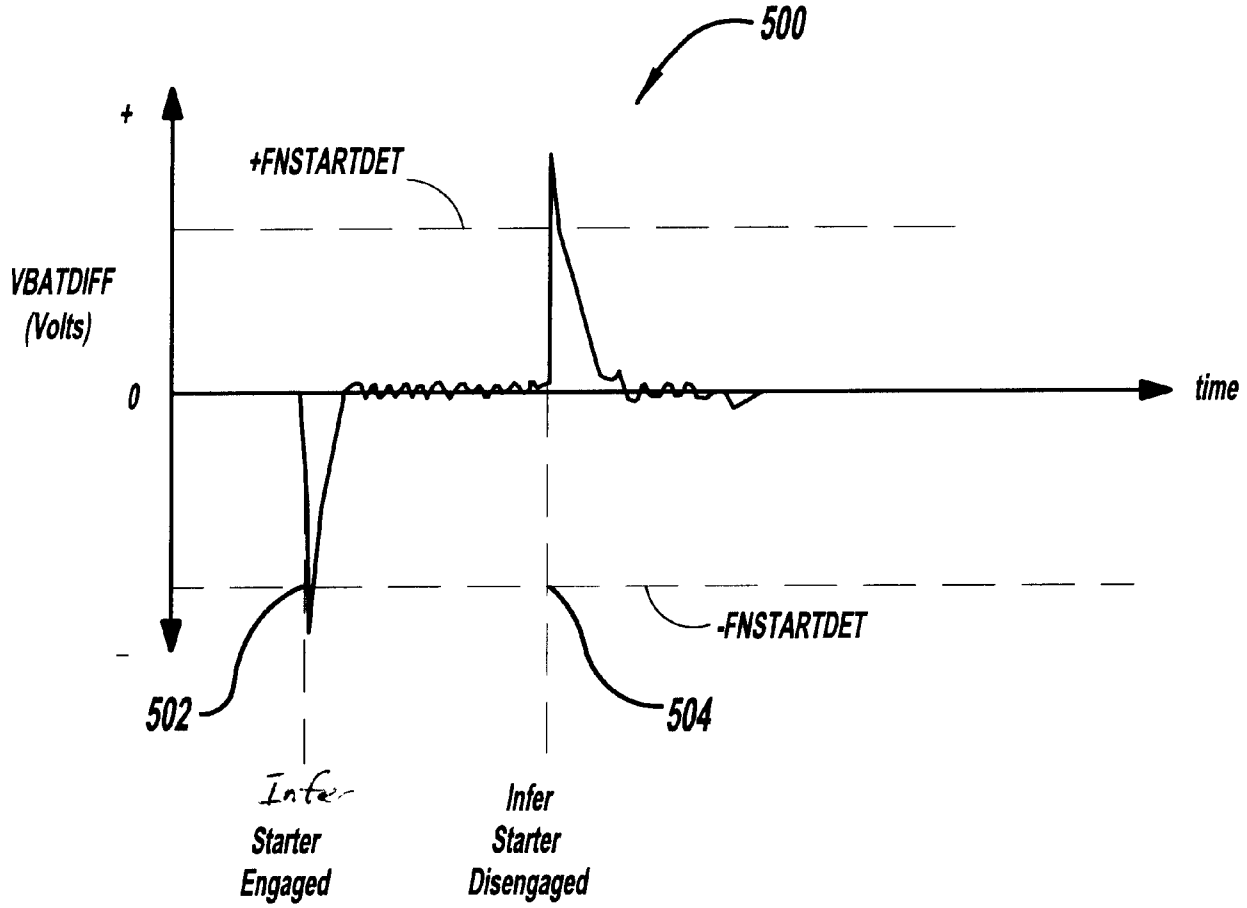
FIG. 5 is a representative plot of a difference between a detected and the filtered vehicle battery voltage over time.

FIG. 5 further illustrates the use of FNSTARTDET to infer the operational state of a vehicle starter motor. FIG. 5 shows a representative plot 500 of VBAT_DIFF as a function of time during a typical cranking sequence of a motor vehicle. In accordance with the a preferred method of the present invention, starter motor engagement is inferred at a time 502 by detecting a sufficient battery voltage drop that is most likely caused by the starter motor beginning to overcome the inertia of the stopped engine. Starter motor engagement can also be inferred by a sensor indication signal generated when the engine is turning, but only on the first start attempt after power up. Starter disengagement by contrast corresponds to an upward spike on the battery voltage corresponding to a sudden increase in VBAT_DIFF at time 504.

Figure 6:
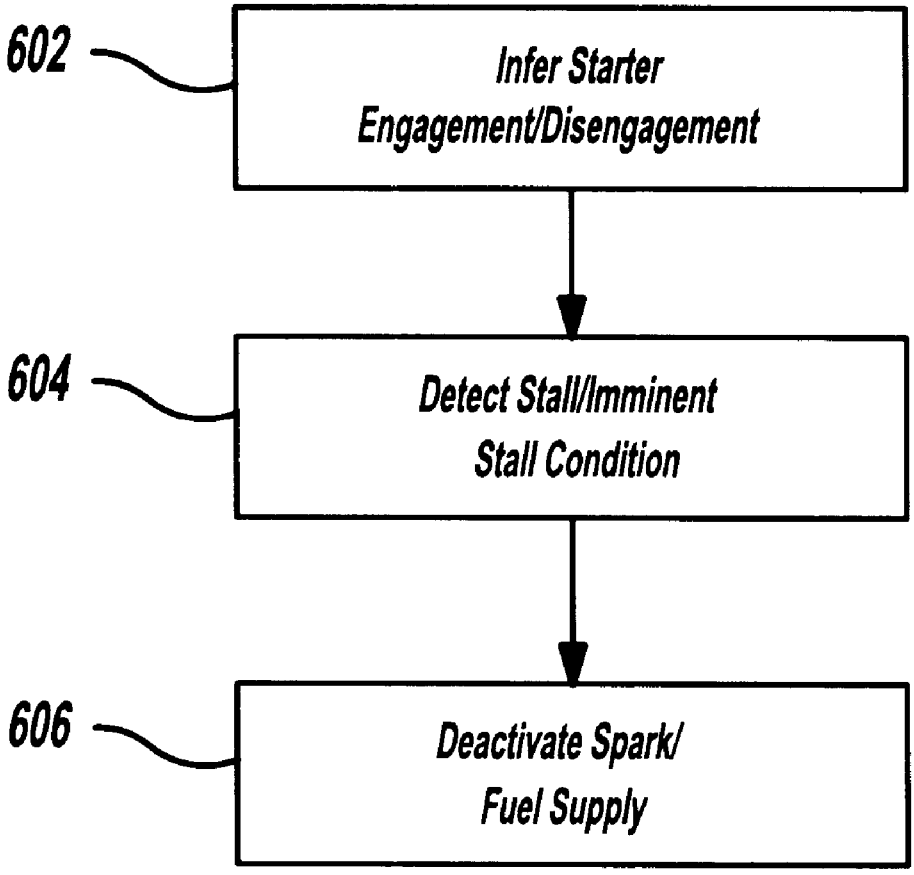
FIG. 6 is a flow diagram of preferred method for preventing engine reverse rotation utilizing the method of FIG. 2.

FIG. 6 shows a flow diagram of a preferred method for preventing engine reverse rotation. The method of FIG. 6 utilizes the methods of FIGS. 2 and 3, and is described below as an exemplary application of the above-described method for inferring the operational state of a vehicle starter motor.

Referring again to FIG. 2, a preferred method for preventing engine reverse rotation includes the above-described steps of inferring a starter motor operational state, i.e., determining whether the starter motor is engaged or disengaged, step 602, detecting a stall or imminent stall condition of the engine, step 604, and deactivating one or both of a spark and fuel supply to the engine, step 606. The logic as shown in FIG. 6 is intended to detect the precursor of conditions, i.e., early release of starter motor, imminent engine stall, etc., that may result in reverse rotation. Additionally, there is protection for the loss of correct position information within the vehicle's spark control system. The spark control system can be, for example, an electronic distributorless ignition system (EDIS). If these conditions are detected, the controller terminates fuel supply and instructs the spark control system to cease spark output until the engine comes to a dead stop.

Figure 7:
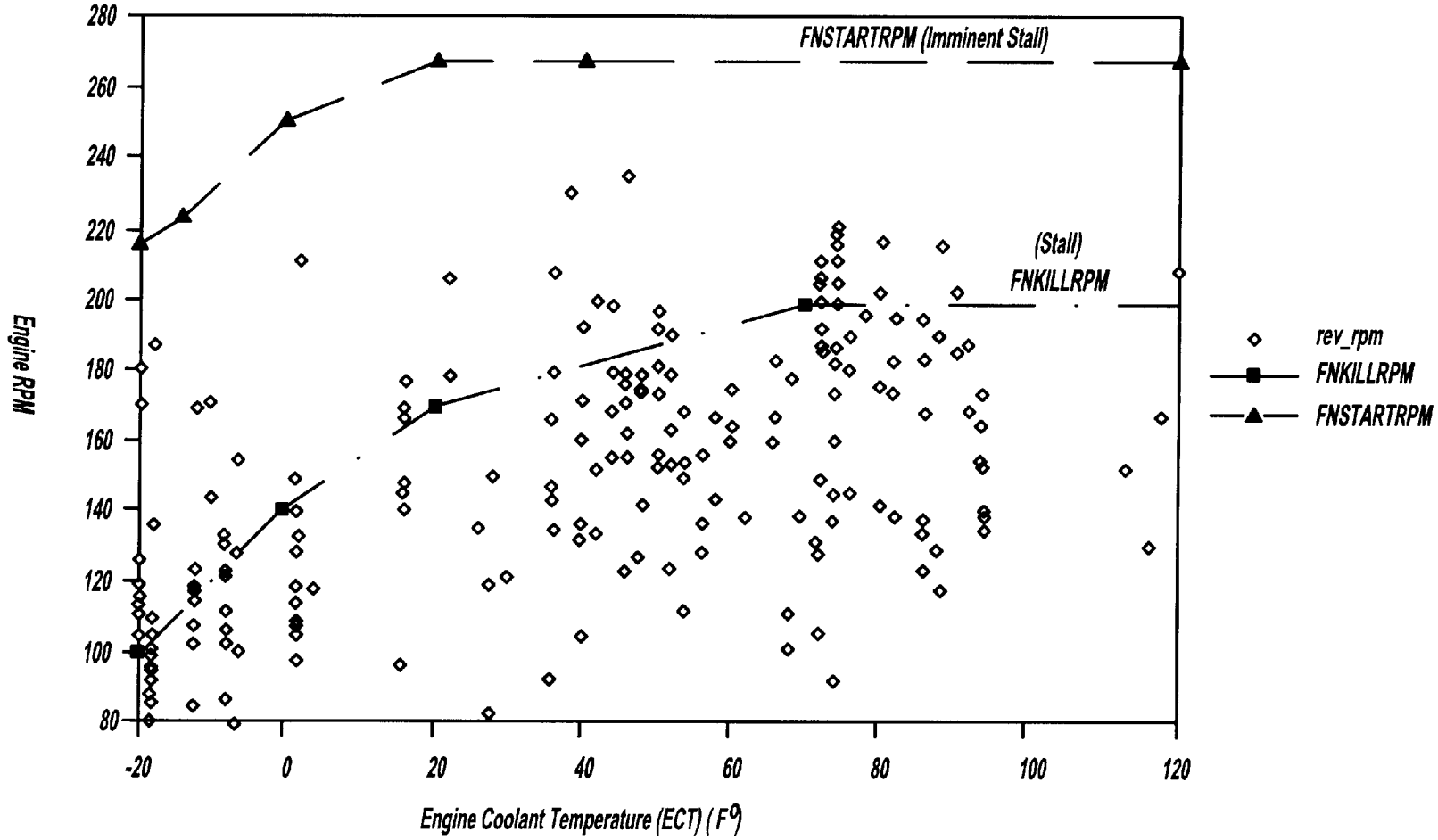
FIG. 7 show exemplary plots of engine speed thresholds for determining stall and imminent stall conditions.
Figure 8:
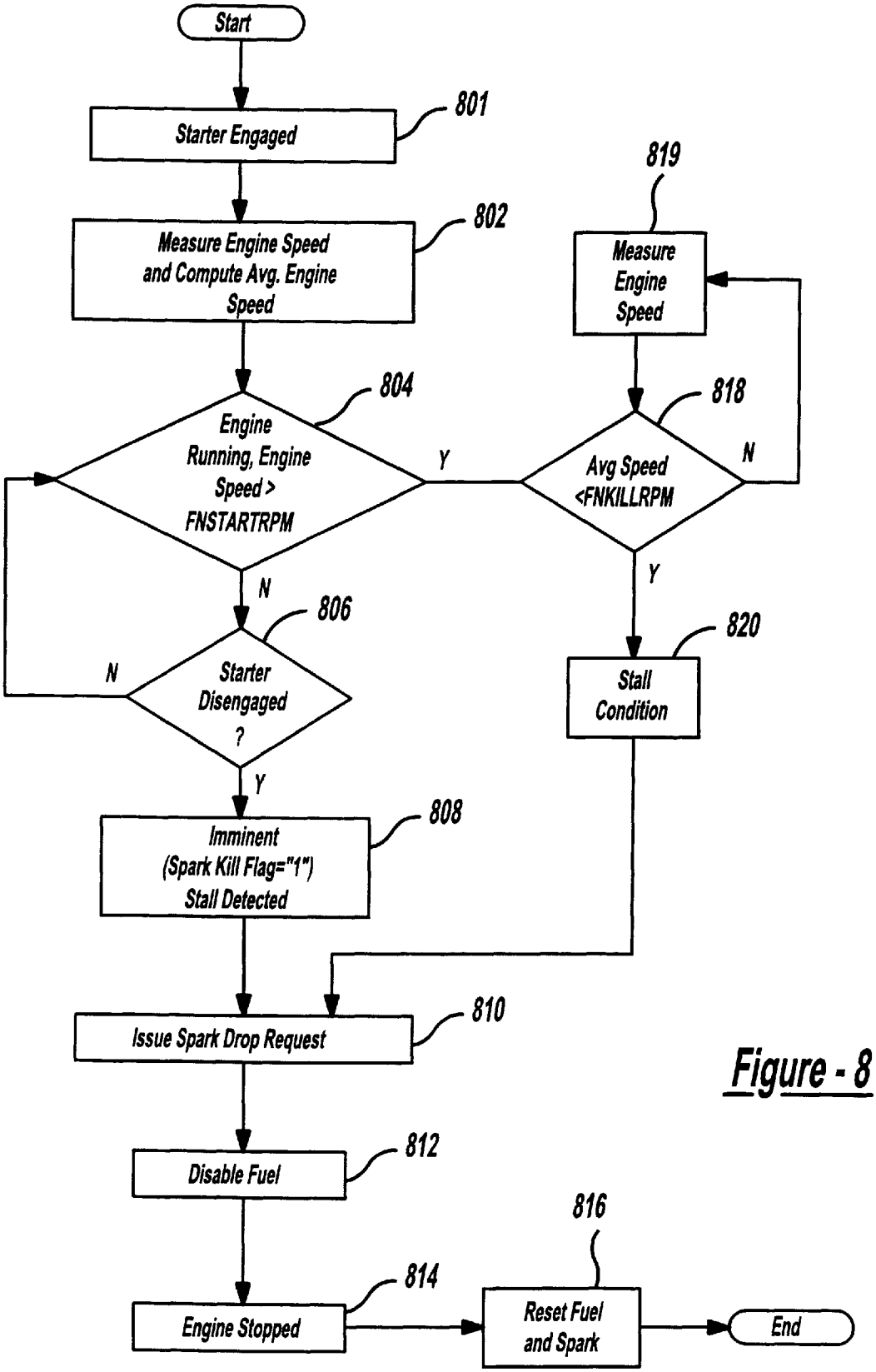
FIG. 8 is a preferred method for detecting stall and imminent stall conditions utilizing the method of FIG. 2.

Step 604, detection of a stall or imminent stall condition of the engine, is now described with reference to FIGS. 7 and 8. FIG. 7 shows an exemplary engine speed threshold for determining stall and imminent stall conditions. The probability of engine reversal increases from "imminent stall" to "stall" as shown by the frequency of engine reversals. FIG. 8 shows a preferred method for detecting stall and imminent stall conditions utilizing the method of FIG. 2.

Referring to FIG. 8, an engine controller detects the rotational speed of a vehicle engine, step 802, preferably using a crank position sensor signal. An average engine speed (AVE_RPM) is updated six times per revolution.

In accordance with step 804, when the engine speed is less than or equal to the first engine speed threshold (FNSTARTRPM), as shown in FIG. 7, and the starter has been disengaged, (step 806) then an "imminent stall" condition is inferred and the controller sets a corresponding flag (SPK_KILL_FLG="1"), step 808. The controller then issues a spark drop request to the vehicle's spark control module (EDIS) step 810 and fuel supply is terminated by the controller (step 812).

After the engine has stopped for a predetermined period of time, step 814, the fuel and spark functions are reset for the next crank cycle (step 816).

Again, referring to FIG. 7, exemplary plots are shown of the FNSTARTRPM and FNKILLRPM engine speed thresholds for determining a stall/imminent stall condition of an internal combustion engine. If AVE_RPM is greater than FNSTARTRPM, then normal engine starting is expected to occur, but occasionally will encounter a stall condition. A secondary portion of the logic is entered as noted in FIG. 8, from step 804 to step 818, where engine speed (AVE_RPM) is continuously compared against FNKILLRPM. If "AVE_RPM" falls below FNKILLRPM, then an engine "stall" condition is inferred and the logic proceeds to step 810, and fuel supply is terminated by the controller.

In FIG. 7, it can be noted than most but not all engine reversals fall below FNKILLRPM. This is acceptable in practice because FNKILLRPM is intended only as a secondary screening method for engine reversals, and is only encountered in a small percentage of cases.

FNSTARTDET, FNSTARTRPM and FNKILLRPM are chosen in accordance with one or more vehicle operating parameters. In Tables 1 through 3 below, FNSTARTDET is chosen as a function of VBAT_STARTER, and FNSTARTRPM and FNKILLRPM chosen as a function of engine coolant engine coolant temperature. The engine coolant temperature is measured or derived by the controller using suitable means as known and appreciated by those of skill in the art. Using measured engine speeds at engine reversal (REV_RPM) at various engine coolant temperatures, the values of FNSTARTRPM and FNKILLRPM are calibrated and selected so as to yield true "imminent stall" and "stall" conditions respectively, and to minimize false inferences of such conditions.

Values for FNSTARTRPM and FNKILLRPM, and also FNSTARTDET, are nominally stored as look-up tables in controller memory. Examples of such tables are provided below for FNSTARTDET, FNSTARTRPM, and FNKILLRPM.

TABLE 1

Example Values for FNSTARTDET (v. VBAT_STARTER)

| | VBAT_STARTER (volts) | | | | | | | |
|---|---|---|---|---|---|---|---|---|
| | 0.00 | 8.00 | 9.00 | 9.50 | 11.00 | 11.50 | 12.00 | 63.99 |
| FNSTARTDET (volts) | 4.875 | 1.375 | 1.150 | 0.870 | 0.625 | 0.630 | 0.700 | 0.700 |

TABLE 2

Example Values for FNSTARTRPM (v. ECT)

| | ECT (*F) | | | |
|---|---|---|---|---|
| | −20 | 0 | 20 | 254 |
| FNSTARTRPM (RPM) | 216 | 244 | 268 | 268 |

TABLE 3

Example Values for FNKILLRPM (v. ECT)

| | ECT (*F) | | | | |
|---|---|---|---|---|---|
| | −20 | 0 | 20 | 60 | 254 |
| FNKILLRPM (RPM) | 124 | 244 | 268 | 220 | 220.00 |

Although the present invention has been described in connection with particular embodiments thereof, it is to be understood that various modifications, alterations and adaptations may be made by those skilled in the art without departing from the spirit and scope of the invention. It is intended that the invention be limited only by the appended claims.

What is claimed:

1. A method for determining an operational state of a vehicle starter motor coupled to vehicle battery, comprising:

detecting a vehicle battery voltage;

deriving an average vehicle battery voltage;

inferring the operational state of the starter motor based at least in part on a difference between the detected vehicle battery voltage and the average vehicle battery voltage.

2. The method according to claim 1, further comprising the step of comparing the difference between the detected vehicle battery voltage and the average vehicle battery voltage to a first voltage threshold value to determine whether the starter motor is engaged or disengaged.

3. The method according to claim 2, wherein the first voltage threshold value is calibrated as a function of at least one vehicle operating parameter.

4. The method according to claim 3, wherein the at least one vehicle operating parameter is the average vehicle battery voltage.

5. The method according to claim 1, further comprising the step of indicating the starter motor as being disengaged if the starter motor is previously determined to be enabled and the difference between the measured and average battery voltages is greater than a second voltage threshold value.

6. The method according to claim 5, wherein the second voltage threshold value is calibrated as a function of at least one vehicle operating parameter.

7. The method according to claim 6, wherein the at least one vehicle operating parameter is the average vehicle battery voltage.

8. A method for determining an operational state of a vehicle starter motor coupled to a vehicle battery, comprising:

measuring a vehicle battery voltage;

deriving a filtered vehicle battery voltage based at least in part on the measured vehicle battery voltage;

deriving a difference between the measured vehicle battery voltage and the filtered vehicle battery voltage;

comparing the computed difference between the measured and filtered vehicle battery voltages to a threshold value; and inferring the operational state of the starter motor based on said comparison step.

9. The method according to claim 8, further comprising the step of indicating the starter motor as being engaged if the starter motor is previously determined to be disabled and an absolute value of the difference between the measured and filtered battery voltages is greater than and a threshold value.

10. The method according to claim 8, further comprising the step of indicating the starter motor as being disengaged if the starter motor is previously determined to be enabled and the difference between the measured and filtered battery voltages is greater than a threshold value.

11. The method according to claim 8, wherein said step of deriving the filtered vehicle battery voltage comprises using a first order filter.

12. A system for determining an operational state of a vehicle starter motor, comprising:

a sensor for measuring a battery voltage; and a controller coupled to said sensor for deriving an average battery voltage based on the measured battery voltage and for inferring the operational state of the starter motor based at least in part on a difference between the sensed battery voltage and the average battery voltage.

13. An article of manufacture for determining an operational state of a vehicle starter motor, comprising:

a computer usable medium; and a computer readable program code embodied in the computer usable medium for directing a computer to control the steps of deriving an average battery voltage based on the measured battery voltage and for inferring the operational state of the starter motor based at least in part on a difference between the sensed battery voltage and the average battery voltage.

* * * * *